United States Patent [19]

Noé et al.

[11] Patent Number: 4,534,198

[45] Date of Patent: Aug. 13, 1985

[54] COOLING HOT-ROLLED STEEL STRIP

[75] Inventors: Oskar Noé; Andreas Noé, both of Mühlheim; Rolf Noé, Berlin-Charlottenburg, all of Fed. Rep. of Germany

[73] Assignee: BWG Bergwerk - und Walzwerk-Maschinenbau GmbH, Duisburg, Fed. Rep. of Germany

[21] Appl. No.: 532,267

[22] Filed: Sep. 14, 1983

[30] Foreign Application Priority Data

Sep. 15, 1982 [DE] Fed. Rep. of Germany ..... 3234162

[51] Int. Cl.[3] ..... B21B 45/02

[52] U.S. Cl. ..... 72/201; 266/112

[58] Field of Search ..... 72/201, 251; 134/64 R, 134/122 R, 124; 266/111, 112; 148/153

[56] References Cited

U.S. PATENT DOCUMENTS

| | | | |
|---|---|---|---|
| 526,433 | 9/1894 | Bildt | 266/112 X |
| 3,224,356 | 12/1965 | Fleisher et al. | 134/64 R |
| 3,818,737 | 6/1974 | Kajiwara et al. | 72/148 X |
| 3,893,465 | 7/1975 | Cheatwood | 266/112 X |
| 3,990,257 | 11/1976 | Taylor et al. | 72/201 X |
| 4,000,625 | 1/1977 | Beerens et al. | 72/201 X |
| 4,415,143 | 11/1983 | Ebata | 266/112 |

FOREIGN PATENT DOCUMENTS

| | | | |
|---|---|---|---|
| 878044 | 9/1961 | United Kingdom | 134/64 R |

*Primary Examiner*—E. Michael Combs

*Attorney, Agent, or Firm*—Karl F. Ross; Herbert Dubno

[57] ABSTRACT

An apparatus used in combination with a hot-rolling line having a succession of roll stands through which passes a strip workpiece in a horizontal transport direction has at least one vessel downstream of the roll stands in the direction and aligned in the direction therewith. This vessel is formed with an upstream inlet and a downstream outlet. A bath of a liquid coolant fills the vessel to a level above the inlet and outlet openings. Guides draw the workpiece from the roll stands into the inlet, through the vessel, and out of the outlet thereof. Thus the workpiece is wholly immersed in and cooled by the liquid coolant within the vessel. A pump feeds fresh coolant into the vessel and withdraws hot coolant therefrom. A plurality of such vessels, each with a respective bath and pump means, is provided with all of the inlets and outlets aligned. The inlet and outlet are formed as horizontally extending slots closely conforming the cross-sectional shape of the workpiece.

7 Claims, 3 Drawing Figures

COOLING HOT-ROLLED STEEL STRIP

FIELD OF THE INVENTION

The present invention relates to the cooling of a hot-rolled strip workpiece. More particularly this invention concerns a method of and apparatus for cooling steel strip after it has been hot rolled.

BACKGROUND OF THE INVENTION

Hot-rolled metal strip emerges from the last stand of a hot-rolling line at a very high temperature, typically about 1000° C. It is therefore necessary to cool this strip to at least about 500° C. both to impart the desired crystalline structure to it, to prevent the buildup of scale, and to make it possible to handle the material.

Accordingly the standard procedure is simply to pull it through a succession of high-pressure sprays that project room-temperature water on the hot strip. Due to the relatively poor heat exchange between such sprays and the workpiece, same must travel between about 60 m and 150 m to cool to the desired temperature of 450° C.–550° C. Once at this temperature, which is still quite hot, the strip is rolled up and set aside.

When the rolls are relatively large, 50 t being a not uncommon size, it takes a full day for them to cool by simple heat exchange with the surroundings to a termperature of 60° C.–80° C. at which they can be handled. While still this hot damage to the coils is fairly common so that subsequent pickling can be complicated also.

Working with these hot coils is extremely difficult and hazardous, entailing very high labor costs. The hot coils also are very hard on the equipment, requiring frequent replacement or heavy shielding and insulation of all parts.

Finally when sprays are used the underside of the strip is typically cooled much less than its upper side, so that the resultant workpiece is not of uniform crystalline structure nd granularity. The result of this is a workpiece that is wavy rather than flat.

OBJECTS OF THE INVENTION

It is therefore an object of the present invention to provide an improved system for cooling a hot-rolled strip workpiece.

Another object is the provision of such a system for cooling a hot-rolled strip workpiece which overcomes the above-given disadvantages, that is which cools the workpiece rapidly enough to allow it to be handled easily right away, and that produces uniform crystalline structure and granularity.

SUMMARY OF THE INVENTION

An apparatus according to this invention is used in combination with a hot-rolling line having a succession of roll stands and through which passes a strip workpiece in a horizontal transport direction. The apparatus has at least one vessel downstream of the roll stands in the direction and aligned in the direction therewith. This vessel is formed with an upstream inlet and a downstream outlet. A bath of a liquid coolant fills the vessel to a level above the inlet and outlet openings. Guides draw the workpiece from the roll stands into the inlet, through the vessel, and out of the outlet thereof. Thus the workpiece is wholly immersed in and cooled by the liquid coolant within the vessel. A pump feeds fresh coolant into the vessel and withdraws hot coolant therefrom.

In this manner it is possible to obtain a high degree of heat exchange between the workpiece and the coolant so that virtually no scale forms on the strip. The layer of water vapor that normally forms in a spraying unit on the steel strip, which layer insulates the strip, does not form with the system of this invention, even though water is used as the coolant. Since the strip is cooled about to room temperature, it is possible to roll it into much larger coils than has hitherto been considered practical.

Such rapid cooling of the workpiece further makes it possible to handle the coils with conventional equipment, and without having to provide special clothing and the like for the workers. Furthermore the reduced scale formation decreases the consumption of acid in the subsequent pickling stage. Rapid cooling produces a mixed transition or so-called dual-phase steel of the low-carbon type which can be drawn and worked easily. Even with austenitic steel with no mixed transition, this rapid cooling avoids irregularities in the granularity.

According to another feature of this invention a plurality of such vessels, each with a respective bath and pump means, is provided with all of the inlets and outlets aligned. Such an arrangement allows the cooling effect to be controlled accurately, and avoids wasting of the this coolant.

The guide means according to this invention includes traction rollers downstream of the vessel. The strip is kept under some tension to run straight and horizontally through the vessels.

In accordance with another feature of this invention the inlet and outlet are formed as horizontally extending slots closely conforming to the cross-sectional shape of the workpiece. These slots can be provided with heat-resistant elastic lips engaging the workpiece and substantially preventing leakage from the vessel. Such lips are ideally of a highly heat-resistant material, normally a synthetic resin.

The guide means according to the invention includes support rollers in the vessel engaging upward underneath the workpiece, and at least one endless openwork belt having an upper stretch extending through the vessel and engaged underneath the workpiece and supporting same. This belt is advanced in the transport direction at the same speed as the workpiece. The belt may be formed as a net or roller chain, or be constituted by parallel endless chains or cables. Further guiding is achieved when the guide means further comprises at least one upper endless openwork belt having a lower stretch extending through the vessel immediately above the workpiece. Such guiding of the workpiece makes sure that it stays below the surface of the bath, and keeps it level.

The pump means introduces the liquid into one side of the vessel and withdraws it from the other, and separate conduits and valves can be provided to control the bath above and below the strip workpiece, which subdivides the bath into upper and lower portions, independently. All the coolant is drained into a common sump or channel below the system for easiest recovery.

The method of the present invention comprises the steps of passing the workpiece downstream of the line through a bath of a liquid coolant with the workpiece wholly immersed therein and replenishing the liquid coolant with fresh coolant. In addition when a plurality of such baths are provided, the method further comprises the step of passing the workpiece between the baths through regions of limited heat exchange with the surroundings. Thus the heat in the core of the workpiece is transmitted to the surface thereof for alternating cooling and reheating thereof. This effect can be achieved simply by leaving some of the vessels empty.

DESCRIPTION OF THE DRAWING

The above and other features and advantages will become more readily apparent from the following, reference being made to the accompanying drawing in which.

SPECIFIC DESCRIPTION

Figure 1A:
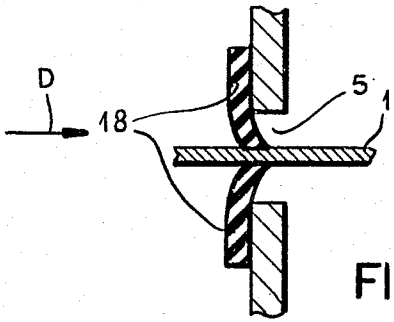
FIG. 1A is a large-scale view of a variation of a detail of FIG. 1.
Figure 1:
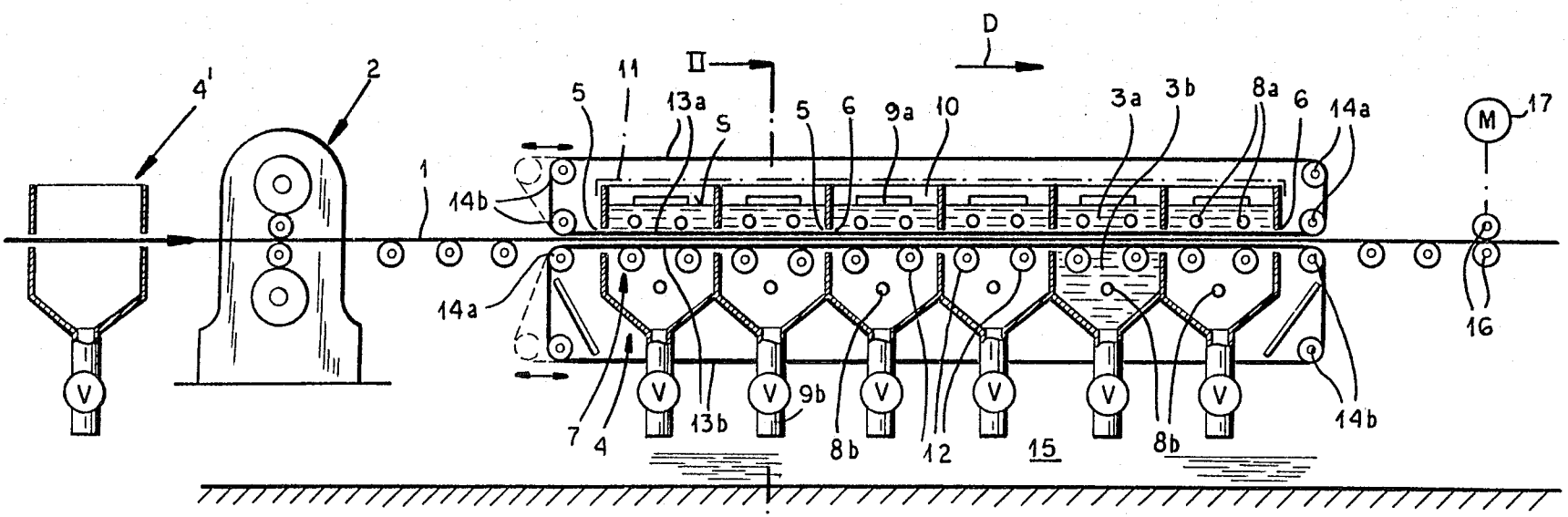
FIG. 1 is a largely schematic vertical section through the apparatus according to the invention.
Figure 2:
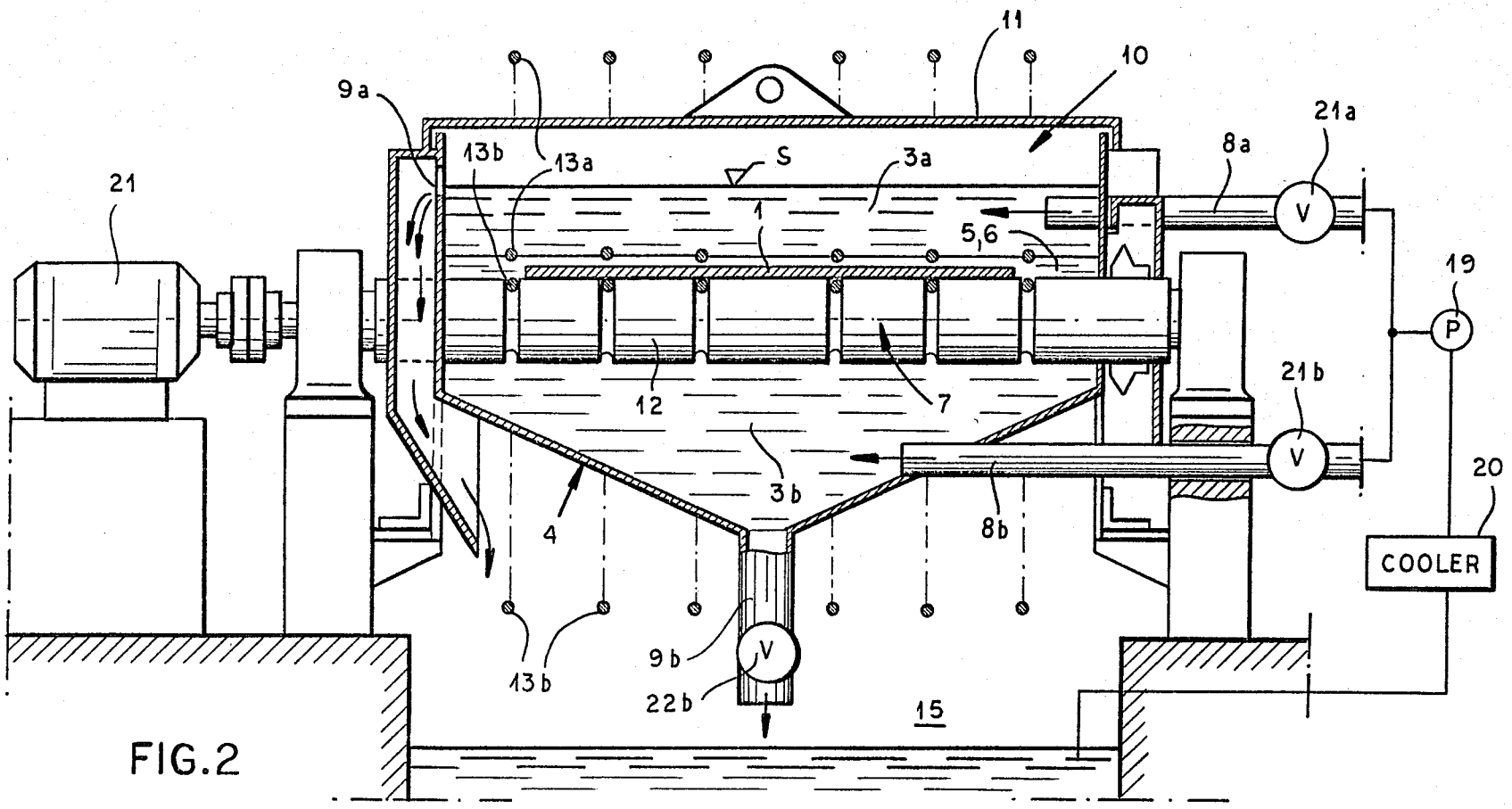
FIG. 2 is a large-scale cross section taken along line II—II of FIG. 1.

As seen in FIG. 1 a strip workpiece 1, here a steel strip, leaves the last roll stand 2 of a rolling-mill line in a transport direction D and enters the first of six identical vessels 4 immediately succeeding one another in this direction D. The workpiece 1 may be pulled through these vessels 4 by a downstream set of tractor rollers 16 driven by a motor 17 at the same peripheral speed as the rollers of the stand 2.

Each such vessel 4 has an upstream inlet opening or slot 5 and a downstream outlet opening or slot 6. In fact a common wall between two such vessels 4 may form the outlet 6 of the upstream vessel 4 and the inlet 5 of the following vessel 4. These openings may be provided with elastic sealing lips 18 as shown in FIG. 1A and of the type described in copending U.S. patent application No. 426,066 filed Sept. 28, 1982.

Each vessel 4 is generally subdivided by the strip 1 into an upper compartment 3*a* and a lower compartment 3*b* and is entirely filled with a liquid coolant, here water, to a level S above the strip 1. The water is introduced into these compartments 3*a* and 3*b* by respective upper and lower input conduits 8*a* and 8*b* having respective independently controlled valves 11*a* and 21*b* and is withdrawn through upper and lower output conduits 9*a* and 9*b*, the former having mouths forming overflow openings. The output conduits 9*a* and 9*b* empty into a sump or channel 15 connected to the intake of a cooler 20 connected in turn to the intake of a pump 19 whose output is connected via the valves 21*a* and 21*b* to the conduits 8*a* and 8*b*. In addition the lower outlet conduit 9*b* has a valve 22*b* that allows the relative flows through the two outlet conduits 9*a* and 9*b* of a single vessel 4 to be regulated by a central computer-type controller connected to temperature sensors in the separate vessels 4.

Within the vessels 3 the strip 1 is supported and held by a conveyor 7 constituted by two grooved rollers 12 within each lower compartment 3*b* and upper and lower endless openwork belts 13*a* and 13*b*. These belts 13*a* and 13*b* are formed by meshes, chains, or, as illustrated, by parallel cables. They are spanned over respective sets of drive rollers 14*a* and 14*b*. The lower belt 13*b* is driven by the rollers 12 which are in turn driven by respective drive motors 21 and similar such drives may be provided for the upper belt 13*a*, or same may idle.

This arrangement ensures thorough and even wetting and uniform cooling of the workpiece 1 in a relatively short space, producing good crystalline structure. In addition another such vessel 4' identical to the vessels 4 may be provided immediately upstream of the last roll stand 2 to cool the workpiece 1 before it is rolled thereby. The result is an extremely fine crystalline structure.

It is also possible for the system to operate with spaces between the vessels 4, or to have some of these vessels 4 empty so that the workpiece reheats between them. This alternate heating and cooling produces a very fine grain structure and a very high-quality finished product. In combination with the individually controlled cooling effects it is therefore possible to create a wide range of different crystalline structures in the workpiece.

We claim:

1. In combination with a hot-rolling line having a succession of roll stands through which passes a strip workpiece in a horizontal transport direction, a strip-cooling apparatus comprising:

at least one vessel downstream of the roll stands in the direction and aligned in the direction therewith, the vessel being formed with an upstream inlet and a downstream outlet;

a bath of a liquid coolant filling the vessel to a level above the inlet and outlet;

a lower endless belt having an upper stretch extending through the vessel immediately below and engaging the lower surface of said workpiece and supporting same;

an upper endless belt having a lower stretch extending through the vessel immediately above and engagable with the upper surface of the workpiece, said upper and lower endless belts being positioned below the level of the coolant;

means for advancing one of the stretches of at least one of the belts in the transport direction at the same speed as the workpiece;

means for drawing the workpiece from the roll stands into the inlet, through the vessel between the belt stretches, and out of the outlet thereof, whereby the workpiece is wholly immersed in and cooled by the liquid coolant within the vessel; and pump means for feeding fresh coolant into the vessel and for withdrawing hot coolant therefrom.

2. The strip-cooling apparatus defined in claim 1 wherein a plurality of such vessels, each with a respective bath and pump means, is provided with all of the inlets and outlets aligned, the stretches extending through all of the aligned inlets and outlets and the upper and lower belts having respective upper and lower stretches extending in the transport direction outside the vessels.

3. The strip-cooling apparatus defined in claim 1 wherein the drive means includes traction rollers downstream of the vessel.

4. The strip-cooling apparatus defined in claim 1 wherein the inlet and outlet are formed as horizontally extending slots closely conforming to the cross-sectional shape of the workpiece.

5. The strip-cooling apparatus defined in claim 4 wherein the inlet and outlet are provided with heat-resistant elastic lips engaging the workpiece and substantially preventing leakage from the vessel.

6. The strip-cooling apparatus defined in claim 1, further comprising:

support rollers in the vessel engaging upward underneath the upper stretch of the lower belt and the workpiece.

7. The strip-cooling apparatus defined in claim 1 wherein the belts are openwork.

* * * * *